United States Patent [19]

Mazumder et al.

[11] Patent Number: 4,685,816

[45] Date of Patent: Aug. 11, 1987

[54] IMPACT PRINTER WITH MEANS FOR ADJUSTING THE ASSOCIATED PRINT HAMMER

[75] Inventors: Ali T. Mazumder; Brian M. Fairey, both of Waterloo, Canada

[73] Assignee: NCR Corporation, Dayton, Ohio

[21] Appl. No.: 805,681

[22] Filed: Dec. 6, 1985

[51] Int. Cl.[4] ..... B41J 9/127

[52] U.S. Cl. ..... 400/157.1; 400/55; 400/157.3; 400/166; 101/93.48; 101/234

[58] Field of Search ..... 101/233-235, 101/93.48; 400/55-59, 174, 175, 352, 449, 354, 692, 355, 157.1, 157.3, 166, 167

[56] References Cited

U.S. PATENT DOCUMENTS

| | | | |
|---|---|---|---|
| 2,226,931 | 12/1940 | Helmond | 400/256 |
| 3,666,071 | 5/1972 | Purr | 400/355 |
| 3,748,613 | 7/1973 | Venker | 335/268 |
| 3,776,341 | 12/1973 | Dobner | 400/157.3 |
| 3,921,780 | 11/1975 | Gentzlinger et al. | 400/55 |
| 3,998,154 | 12/1976 | Real et al. | 101/93.48 |
| 4,004,505 | 1/1977 | Magnenet | 101/93 |
| 4,086,997 | 5/1978 | Wu | 400/59 |
| 4,098,389 | 7/1978 | Kwan | 400/649 |
| 4,133,262 | 1/1979 | Beery | 101/235 |
| 4,229,114 | 10/1980 | Van Horne | 400/692 |
| 4,514,100 | 4/1985 | LaSpesa | 400/175 |
| 4,514,101 | 4/1985 | Smith | 400/59 |
| 4,522,122 | 6/1985 | Mazumder | 101/93.02 |
| 4,525,084 | 6/1985 | Ikeda | 400/55 |
| 4,607,967 | 8/1986 | Hirata et al. | 400/352 |

FOREIGN PATENT DOCUMENTS

| | | | |
|---|---|---|---|
| 3226730 | 2/1983 | Fed. Rep. of Germany | 400/59 |
| 51376 | 5/1981 | Japan | 400/56 |
| 157776 | 9/1982 | Japan | 400/56 |

OTHER PUBLICATIONS

Carpenter et al, "Forms Sensor . . . ", IBM Technical Disclosure Bulletin, vol. 13, No. 12, p. 3643, 5-71.

*Primary Examiner*—William Pieprz

*Attorney, Agent, or Firm*—Wilbert Hawk, Jr.; Albert L. Sessler, Jr.; Elmer Wargo

[57] ABSTRACT

An impact-type, printing apparatus which is readily adjusted to enable the impact face of the associated print hammer to be precisely located with reference to the plane of a character (or a typewheel) to be printed to enable printing in special fonts like E13-B. First and second eccentric members and a separate moveable member are used to provide the adjustments necessary for the precise location of the impact face.

6 Claims, 11 Drawing Figures

IMPACT PRINTER WITH MEANS FOR ADJUSTING THE ASSOCIATED PRINT HAMMER

BACKGROUND OF THE INVENTION

This invention relates to impact printers, and more specifically, it relates to a means for adjusting the impact face of the associated print hammer so as to be precisely positioned at impact and thereby be capable of accurately printing characters in special printing styles or fonts, like E13-B, for example.

During the processing of financial documents, like checks, by financial institutions, like banks, a point is reached in the processing at which the monetary amount of each check is printed on the front of the check in the area below the signature line; this process is generally referred to as "encoding". The monetary amount is printed on the check in a magnetic-type ink which is generally referred to as "MICR" ink, with "MICR" being an acronym for "magnetic ink character recognition." Banks in the U.S.A. generally use the E13-B font or style mentioned in the encoding process.

Because the characters produced in the E13—B font are read magnetically, it is necessary that the characters be precisely printed in MICR ink in order that they be read accurately at subsequent processing operations. If the impact face of the print hammer is not properly aligned with the character to be printed during the printing operation, improperly printed characters will result, and misreading or non-reading of data will occur at subsequent processing operations.

Some known techniques for aligning the impact face of the print hammer of an impact-type printer with the character to be printed are performed by using shims, bending the print hammer beam, and changing the pivot point of the print hammer beam. These known techniques require a fairly-skilled operator to perform, and the techniques are time-consuming.

SUMMARY OF THE INVENTION

The printer apparatus of this invention employs a structure which facilitates the mentioned aligning of the impact face of the associated print hammer with the character to be printed.

In addition, the alignment procedure using this invention may be performed with operators who are less skilled than the operators who are required to utilize the known techniques mentioned.

In a preferred embodiment, the printing apparatus of this invention comprises: a base plate; a printing station including a document track which is perpendicular to and secured to said base plate; presenter mean located at said printing station for presenting characters to be printed in a first plane substantially parallel to said document track and located therein; a support plate having a top surface and a bottom surface; a print hammer; means for pivotally mounting said print hammer on said support plate and also for moving said print hammer in a second plane parallel to said top surface of said support plate between non-printing and printing positions relative to said printing station; said print hammer having an impact plane to cooperate with a character on said presenter means to print said character on a document positioned between said presenter means and said impact plane when said hammer is moved to said printing position; said impact plane having mutually perpendicular first and second imaginary axes lying in said impact plane of said print hammer; first and second adjustable eccentric means coupled between said support plate and said base plate to enable said first imaginary axis of said impact plane to be positioned parallel to said first plane when said print hammer is in said printing position; said support plate having a recess in said bottom surface; a moveable adjusting member slidably mounted in said recess next to said base plate to enable said second imaginary axis of said impact plane to be positioned parallel to said first plane when said print hammer is in said printing position; and securing means for securing said first and second adjustable eccentric means and said moveable adjusting member in fixed positions when said print hammer is in said printing position and when said impact plane is parallel to said first plane.

The advantages mentioned, and others, will become more readily understood in connection with the following description, claims, and drawing.

BRIEF DESCRIPTION OF THE DRAWING

FIG. 2 is a side view, in elevation, which is taken from the direction of arrow A in FIG. 1, with several known components being shown in diagrammatic from;

DETAILED DESCRIPTION OF THE INVENTION

Figure 1:
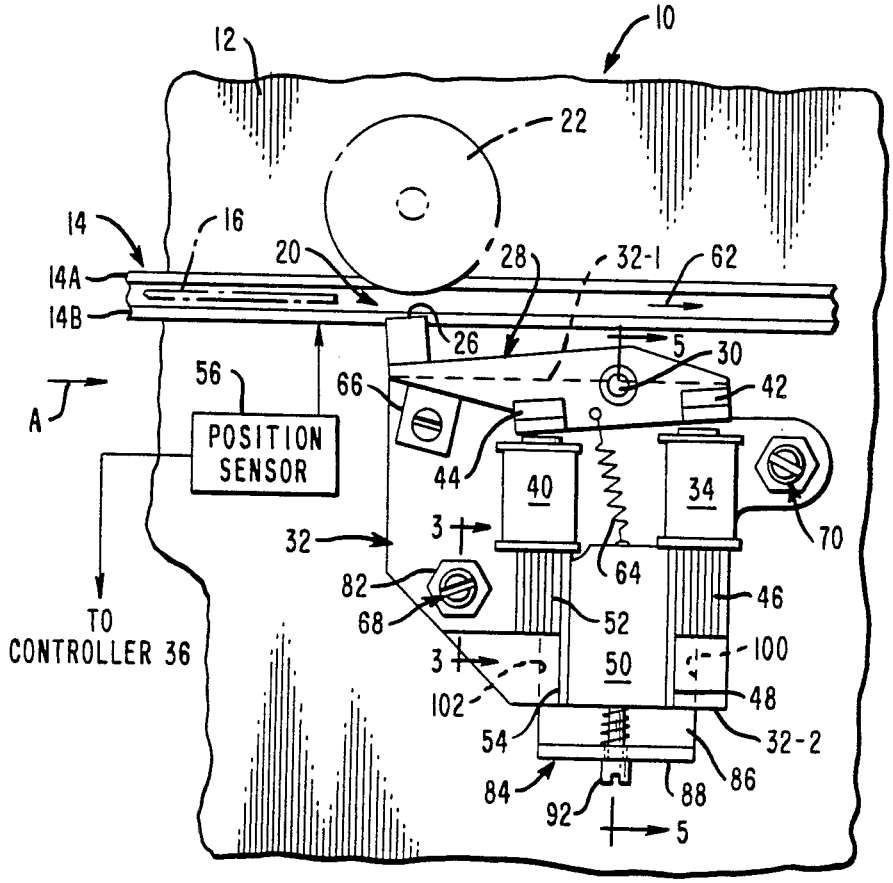
FIG. 1 is a plan view showing the printer apparatus made according to this invention.

FIG. 1 is a plan view of a printing apparatus made according to this invention and designated generally as 10. The apparatus 10 includes a base plate 12 on which a document track 14 is located. The document track 14 has side walls 14A and 14B which are perpendicular to and upstanding from the base plate 12.

Figure 2:
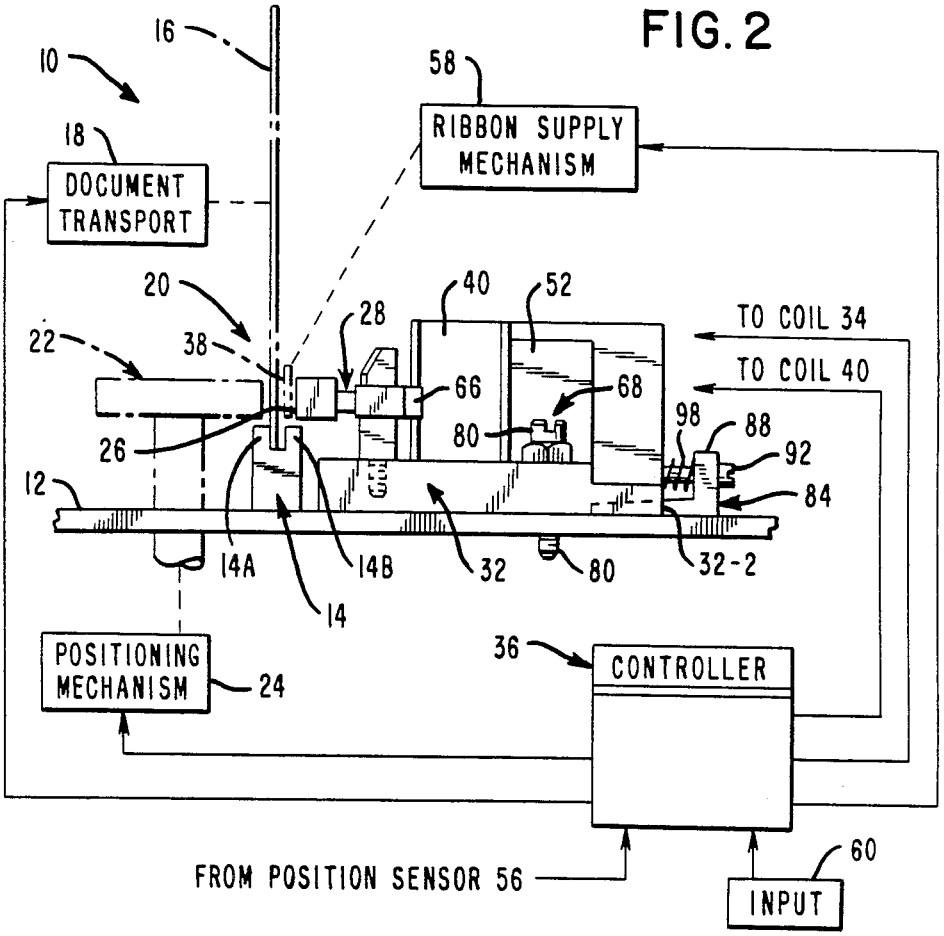

The printer apparatus 10 also includes means for moving documents like document 16 along the track 14, and this means is shown only schematically as document transport 18 (FIG. 2). Printing is effected at the printing station 20 which is located along the document track 14.

The means for presenting characters to be printed at the printing station 20 is shown as a typewheel 22 in FIG. 2. A positioning mechanism shown schematically as 24 is used to rotate or index the typewheel 22 so as to present the character to be printed to the impact plane or face 26 of a print hammer designated generally as 28.

The print hammer 28 is pivotally mounted on a pin 30 (FIG. 1) which is upstanding from a support plate 32. An actuating coil 34, when energized by the controller 36 (FIG. 2), is used to pivot the print hammer 28 in a clockwise direction (as viewed in FIG. 1) to move the impact face 26 into printing relationship with a character on the type wheel 22, the document 16, and a ribbon 38 as shown in FIG. 2. A second coil 40, when energized by the controller 36, is used to return the print hammer 28 to the home position shown in FIG. 2. The print hammer 28 has ferrous members 42 and 44 thereon to coact with the coils 34 and 40, respectively, as is done conventionally. The laminations 46 for the coil 34 are secured to a mounting plate 48 which in turn is secured to a block 50 which is part of the support plate 32. Similarly, the laminations 52 for the coil 40 are secured to a a mounting plate 54 which in turn is secured to the block 50.

The apparatus 10 includes a position sensor 56 (FIG. 1) which detects the leading edge of a document 16 approaching the printing station 20 and also includes a ribbon supply mechanism 58, shown only schematically in FIG. 2. In the embodiment described, the ribbon 38 is filled with a MICR or magnetic ink, and the characters on the typewheel 22 conform to the E13-B format or font, for example, as alluded to earlier herein. An input 60 to the controller 36 is used to provide the data, like monetary amount, to be printed on the document 16. The controller 36 then actuates the positioning mechanism 24, which, in turn, indexes the typewheel 22 to present the character to be printed. The controller 36 then energizes coil 34 to pivot the print hammer 28 and thereby move the impact face 26 into printing engagement with the character at the printing station 20. Thereafter, the actuating coil 34 is de-energized, and the return or second coil 40 is energized by the controller 36 to return the print hammer 28 to the home position shown in FIG. 1. The document transport 18 is then energized by the controller 36 to move the document 16 one character position in a downstream direction (shown by arrow 62), and thereafter, the process described is repeated for the characters to be printed. In the embodiment described, the printing or encoding in MICR ink is performed on the lower-right, front side of the check 16 under the signature line thereon. When the printing apparatus is not in use, a tension spring 64 is used to resiliently bias the print hammer 28 to the home position against the stop block 66 shown in FIG. 1.

As alluded to earlier herein, if the impact face 26 of the print hammer 28 is not parallel to the plane of a character on the type wheel 22 at the moment of impact, the MICR character produced thereby will not be accurately formed. Because these MICR characters are read magnetically, they will not produce the precise, magnetic wave shapes necessary to enable them to be read accurately or to be read at all during subsequent processing operations when the monetary amount is machine read. As previously stated, it is difficult to align the impact face 26 by the known techniques mentioned earlier herein.

The printing apparatus 10 facilitates the aligning of the impact face 26 to produce precise characters at the printing station 20. In this regard, the support plate 32 (FIGS. 5A, 5B, and 5C) has a top surface 32-T and a bottom surface 32-B as shown. The print hammer 28 (shown only in dashed outline in FIGS. 5A, 5B, and 5C) is mounted on the support plate 32 for movement in a plane which is parallel to the top surface 32-T of the support plate 32. Notice, also, that the support plate 32 is tapered in thickness, with the end 32-1 which is closest to the document track 14 being thicker than the opposite end 32-2 (FIG. 1) with regard to the top surface 32-T; this is shown by dashed line 33 in FIG. 5A which represents an extension of top surface 32-T. In other words, the planes represented by top surface 32-T and bottom surface 32-B tend to converge towards the right as viewed in FIG. 5A. The means for coupling the support plate 32 to the base plate 12 includes two eccentric members designated generally as 68 and 70 as shown in FIG. 1. The eccentric member 70 is positioned closer to the document track 14 than is the eccentric member 68. Because the eccentric members 68 and 70 are identical, a discussion of only eccentric member 68 will follow.

Figure 3:
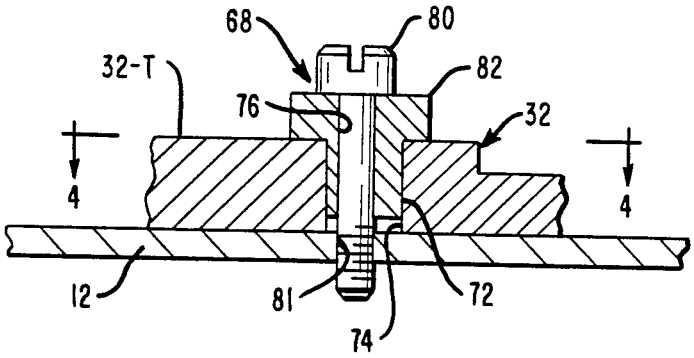
FIG. 3 is a cross-sectional view, taken along the line 3—3 of FIG. 1, to show more details of an eccentric used in the apparatus.
Figure 4:
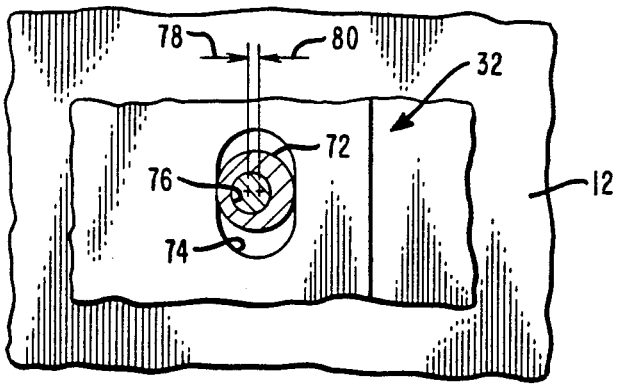
FIG. 4 is a cross-sectional view taken along the line 4—4 of FIG. 3.

The eccentric member 68 (FIGS. 1, 3 and 4) includes an eccentric bushing portion 72 which has an outer diameter which is dimensioned to fit within the elongated hole 74 (FIG. 4) of the support plate 32. The eccentric member 68 also has a hole 76 therein which is offset from the longitudinal axis of the bushing portion 72 to provide the displacement indicated by arrows 78 and 80 in FIG. 4 for the embodiment being described. A screw 80, which slidably fits in the hole 76 and is secured in a threaded hole 81 (FIG. 3) in the base plate 12, provides the means for securing the eccentric member 68 and the support plate 32 in an adjusted, fixed position relative to base plate 12. A hex 82 formed on the bushing portion 72, when rotated with a wrench (not shown), provides for an adjustment of the displacement mentioned.

Figure 5A:
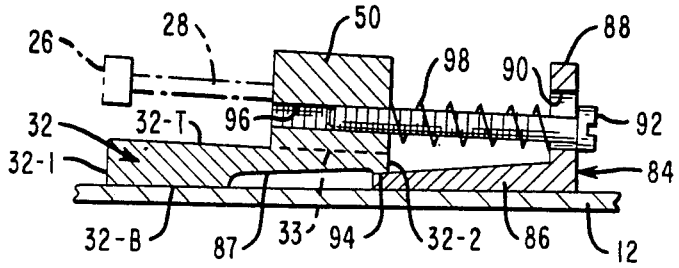
FIGS. 5A, 5B, and 5C are cross-sectional views taken along the general line 5—5 of FIG. 1.
Figure 5B:
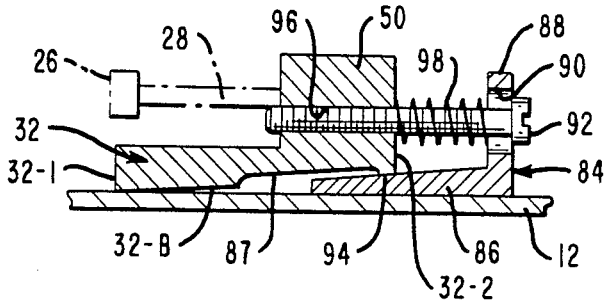
Figure 8:
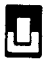
Figure 5C:
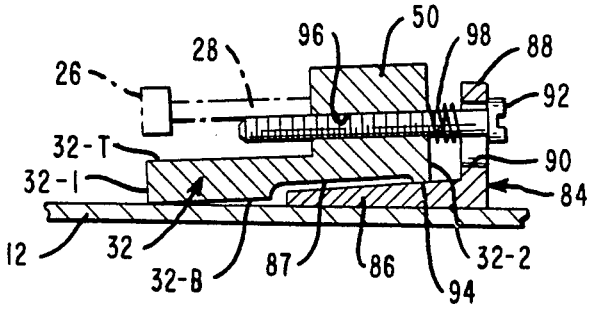

Another adjustment for the printing apparatus 10 is effected through the use of a moveable adjusting member which is designated generally as 84 as shown in FIGS. 1 and 5A, for example. The member 84 has a tapered, first portion 86 which is complementary to the taper in the area 87 of the support plate 32. The member 84 also has an extension 88 having an elongated hole 90 therein to loosely receive the adjusting fastener 92. The lower side of the support plate 32 has a projection 94, which remains, due to area 87 being recessed slightly, to provide some clearance between the support plate 32 and the tapered, first portion 86 of the member 84 to thereby minimize the friction therebetween when the member 84 is moved between the positions shown in FIGS. 5A and 5C. The first portion 86 is thinner in thickness at the end located under projection 94, as viewed in FIG. 5A, than it is at the end near the extension 88. The fastener 92 is threadedly received in a threaded hole 96 in the block 50. The member 84 is resiliently biased to the position shown in FIG. 5A by a compression spring 98. The moveable member 84 is guided towards and away from the document track 14 in a recess located in the underside of support plate 32, with this recess being shown by the dashed lines 100 and 102 in FIG. 1.

In order to discuss how adjustments are made to the apparatus 10 to get the impact face 26 of print hammer 28 in a desired position, it is useful to consider certain imaginary planes and axes. In this regard, a selected character on the type wheel 26, when positioned for printing, may be considered to lie in an imaginary, vertical plane which is perpendicular to the base plate 12 and parallel to the document track 14. The impact face 26 of the print hammer 28 may be considered to have first and second mutually perpendicular axes thereon, with the first axis being parallel to the imaginary, vertical plane mentioned and with the second axis being perpendicular to the base plate 12 when the selected character, document 16, ribbon 38, and impact face 26 of the print hammer 28 are in the proper, printing relationship at impact.

Assume for the moment that the impact face 26 of print hammer 28 is not adjusted at all. To adjust the printing apparatus 10, the screws 80 of the eccentric members 68 and 70 are loosened to enable the support plate 32 and the moveable member 84 to be moved to position the impact face 26 approximately parallel to the imaginary vertical plane mentioned at the impact position. After this is done, the screws 80 of the eccentric members 68 and 70 are tightened, and a character is printed to determine the alignment of the printing apparatus 10.

Figure 6:
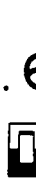
FIGS. 6, 7, and 8 are views of the number "0" which is formed by the adjustment positions shown in FIGS. 5A, 5B, and 5C, respectively.
Figure 7:
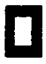
Figure 9:
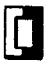
FIG. 9 is a view of the number "0" which is formed improperly, requiring adjustment of the printing apparatus 10.

FIGS. 6, 7, 8, and 9 show the number 0 or zero as printed by different adjustments of the apparatus 10. The zero shown in each of the FIGS. 6–9 is show in double outline merely to facilitate showing which portions, if any, of a character are not printed properly. For example, the zero shown in FIG. 7 is printed properly in that the top and bottom, and left and right sections, as viewed in FIG. 7, are all of equal density as shaded. In FIG. 6, for example, the bottom half of the character is printed, but the top half of the character is not printed. In FIG. 9, the right half of the character (as viewed in FIG. 9) is printed, but the left side is not.

Assume that a trial printing is performed by the printing apparatus 10, and that the number 0 is printed as shown in FIG. 6. Because the left and right halves of the number 0 in FIG. 6 are of equal density, and only the top half is not printing, the following adjustment procedure is used. The screws 80 of the eccentric members 68 and 70 are loosened to permit the moveable member 84 to be advanced towards the document track 14 by advancing the screw 92 to move the moveable member 84 to the approximate position shown in FIG. 5B. This action adjusts the print hammer 28 so that the second axis on the impact face 26 is perpendicular to the base plate 12 during impact.

After the adjustment mentioned, the screws 80 of the eccentric members 68 and 70 are tightened, and the printing apparatus 10 is operated to check on the resulting printing. If the characters appear as shown by the number 0 in FIG. 8, the screws 80 of the eccentric members 68 and 70 are loosened again, and the screw 92 is withdrawn from the position shown in FIG. 5C to approximately that shown in FIG. 5B. Thereafter the screws 80 are tightened, and printing is again performed. If the characters appear as shown by number 0 in FIG. 9, no vertical adjustment is necessary; however, the eccentric members 68 and 70 will have to be adjusted to bring the first axis on the impact face 26 into parallel relationship with imaginary plane mentioned. This imaginary plane is also parallel to the plane of document 16 shown in FIG. 2. The adjustment to the printing apparatus 10 is made by first loosening screws 80 of the eccentric member 68 and 70. Thereafter, a wrench (not shown) is placed on the hex 82 of the first eccentric members 68 and the hex 82 is turned in a way which brings the upstream end of support plate 32 (the end containing block 66) closer to the document track 14. Thereafter, the screws 80 of the eccentric members 68 and 70 are tightened to secure the printing apparatus 10 in the adjusted position. Printing is again performed, and adjustments, if necessary, are made as described by trial and error.

The printing apparatus 10 as just described provides an easy method of adjusting the impact face 26 of the print hammer 28 so as to provide precise printing of characters in printing fonts, like E13-B, for example.

What is claimed is:

1. A printing apparatus comprising:

a base plate;

a printing station including a document track which is perpendicular to and secured to said base plate;

presenter means located at said printing station for presenting characters to be printed in a first plane substantially parallel to said document track and located therein;

a support plate having a top surface and a bottom surface;

a print hammer;

means for pivotally mounting said print hammer on said support plate and also for moving said print hammer in a second plane parallel to said top surface of said support plate between non-printing and printing positions relative to said printing station;

said print hammer having an impact plane to cooperate with a selected one of a plurality of characters on said presenter means to print said character on a document positioned between said presenter means and said impact plane when said hammer is moved to said printing position;

said impact plane having mutually perpendicular first and second imaginary axes lying in said impact plane of said print hammer; first and second adjustable eccentric means coupled between said support plate and said base plate to enable said first imaginary axis of said impact plane to be positioned parallel to said first plane when said print hammer is in said printing position;

said support plate having a recess in said bottom surface;

a moveable adjusting member slidably mounted in said recess next to said base plate to enable said second imaginary axis of said impact plane to be positioned parallel to said first plane and perpendicular to said support plate when said print hammer is in said printing position; and securing means for securing said first and second adjustable eccentric means and said moveable adjusting member in fixed positions when said print hammer is in said printing position and said impact plane is parallel to said first plane.

2. The printing apparatus as claimed in claim 1 in which said apparatus also includes a means for supplying a ribbon containing MICR ink to said printing station and in which said presenter means includes a typewheel with said characters being positioned thereon; said characters being formed to print in a MICR format such as E13-B.

3. The printing apparatus as claimed in claim 1 in which said first and second adjustable eccentric means are spaced apart along the length of said document track and in which said first adjustable eccentric means is positioned farther away from said document track than is said second adjustable eccentric means.

4. The printing apparatus as claimed in claim 3 in which said support plate has first and second opposed ends with said first end being positioned close to said document track and with said second end being positioned away from said document track;

said support plate being tapered in thickness with said second end being thinner in thickness than is said first end;

said moveable adjusting member having first and second opposed ends and being aligned perpendicularly to said document track;

said moveable adjusting member being tapered with said first end of said moveable adjusting member being located closer to said document track than is the associated said second end of said moveable adjusting member and with said first end of said moveable adjusting member being thinner in thickness than is the associated said second end of said moveable adjusting member.

5. The printing apparatus as claimed in claim 4 in which said securing means includes a support block located at said second end of said support plate with said support block having a threaded hole therein;

said moveable adjusting member having an extension extending in a direction which is substantially perpendicular to said base plate; said extension having a hole therein;

said securing means also including an adjusting screw passing through said hole in said extension and being threadedly received in said threaded hole of said support block, and a resilient member positioned between said support block and said extension to resiliently bias said moveable adjusting member away from said support block.

6. The printing apparatus as claimed in claim 5 in which said support plate has elongated first and second holes therein;

said first adjustable eccentric means including an eccentric bushing which is inserted in said first elongated hole, said eccentric bushing having a hole therein; and said second adjustable eccentric means including an eccentric bushing which is inserted in said second elongated hole, said eccentric bushing for said second adjustable eccentric means having a hole therein; and said securing means also including first and second fasteners which pass through said holes in the associated said eccentric bushings of said first and second adjustable eccentric means and are threadedly secured to said base plate.

* * * * *